United States Patent [19]

Connell et al.

[11] 4,445,638

[45] May 1, 1984

[54] HYDRONIC ANTITRUST OPERATING SYSTEM

[75] Inventors: John C. Connell, Minneapolis; Stephen L. Serber, New Hope, both of Minn.

[73] Assignee: Honeywell Inc., Minneapolis, Minn.

[21] Appl. No.: 419,647

[22] Filed: Sep. 20, 1982

[51] Int. Cl.³ ..... F24D 3/00; F28F 19/00

[52] U.S. Cl. ..... 237/8 R; 236/1 H; 165/134 DP; 431/18

[58] Field of Search ..... 237/8 R, 56, 60, 19, 237/2 A, 7; 236/1 H; 165/134 DP; 431/18

[56] References Cited

U.S. PATENT DOCUMENTS 4,347,972 9/1982 Hillerstrom ..... 237/19

*Primary Examiner*—Albert J. Makay
*Assistant Examiner*—Henry Bennett
*Attorney, Agent, or Firm*—Alfred N. Feldman

[57] ABSTRACT

A hydronic type of heating system is operated by a burner control system that relies on measuring the boiler water temperature and comparing the temperature change with a rate of rise set into a burner control means to determine whether the boiler is being properly operated. This system allows for heating the boiler water to a sufficient temperature before circulating the water through the heat exchange means to thereby prevent condensation on the outside of the boiler heat exchanger to eliminate rusting.

6 Claims, 4 Drawing Figures

HEAT EXCHANGER MEANS 20
BOILER HEAT EXCHANGER 13
BURNER
FUEL CONTROL MEANS 30
FLAME DETECTOR MEANS 43
SIGNAL PROCESSING MEANS 40
BURNER CONTROL MEANS 25
10
11
12
14
15
16
17
21
22
23
24
26
27
31
32
33
35
36
41
42
44
45

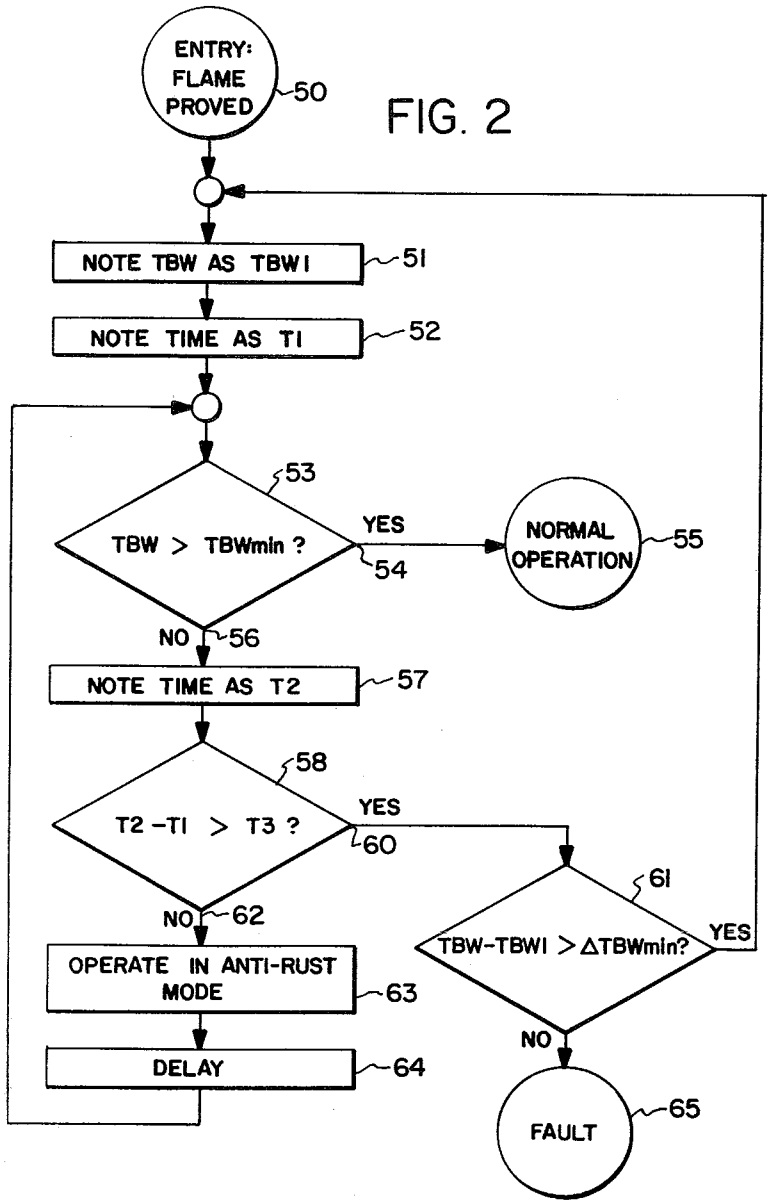
FIG. 2
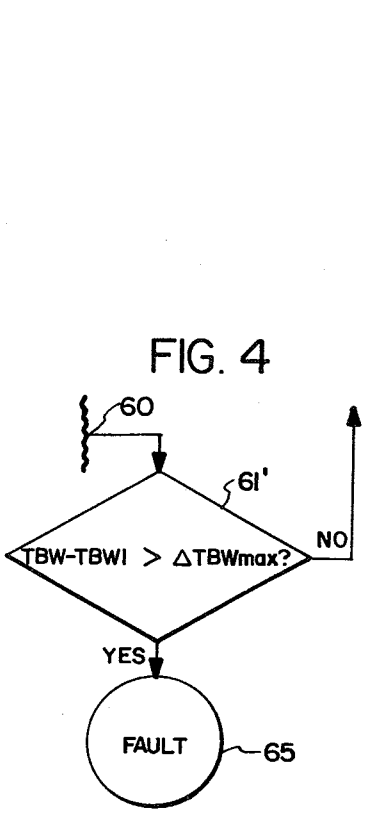
FIG. 3
FIG. 4

HYDRONIC ANTITRUST OPERATING SYSTEM

BACKGROUND OF THE INVENTION

Heating systems that rely on the circulation of hot water or steam from a boiler through heat exchange means are generally known as hydronic type heating systems. Hot water hydronic heating systems typically have been operated with a circulating pump energized concurrently with a fuel burner which heats water in the boiler. With this type of a hydronic system operation, the circulator pump initially starts circulating water that is relatively cool through heat exchangers in the boiler and in the house (radiators) and back to the boiler. This tends to reduce the boiler temperature to a point where condensation of the water in the combustion products occurs on the outside of the boiler heat exchanger and this in turn leads to rusting of the heat exchanger. This type of an operation shortens the life of the boiler heat exchanger and is undesirable.

One way to avoid this type of corrosive action is to provide the boiler with a sensor that controls the circulator by temperature. The burner is put into operation and the circulator pump is held out of operation until some predetermined temperature has been reached that is considered high enough to avoid condensation on the outside of the boiler heat exchanger. Typically, this is a temperature of 105 degrees Fahrenheit. This type of a system, if reliable, would generally solve the rusting problem.

Unfortunately, this type of a system has the potential to be unreliable. The temperature sensor may fail to act properly, and the boiler can be operated indefinitely without the temperature rise being sensed or properly acted upon. By merely sensing the boiler water temperature and operating the circulator pump based on a fixed temperature, many operating problems are undetected and the system can be either inefficiently or unsafely operated.

SUMMARY OF THE INVENTION

In the present invention a hydronic type of boiler control system is provided wherein an antirust mode of operation is provided that is substantially fail safe. The boiler, the water circulator means, the boiler heat exchanger means, and the house radiators or heat exchanger means are of the conventional design, but the sensing and control mode for the burner and the circulator means or pump relies on more than a mere temperature limit for control. In the present system the temperature of the boiler water is measured and is compared in a time based mechanism to establish whether a proper rate of rise is occurring in the water to indicate that the burner is functioning properly. This rate of rise can be used also for detecting a low water condition which would be detected by an abnormally fast rate of rise. Also, since the present system relies on a timer (or time based device,) a time limit for the rate of rise to occur can be placed into the system thereby ensuring that the system not only comes up to the proper rust inhibiting mode properly, but if the sensor does not indicate heat within some fixed period of time, the system can be shut down and locked out.

BRIEF DESCRIPTION OF THE DRAWINGS

FIG. 2 is a flow chart of the operation of one mode of operating FIG. 1;

FIG. 3 is a flow chart of a further mode of operating the invention, and;

FIG. 4 is a portion of a flow chart similar to that of FIG. 2 but for sensing a low water condition.

DESCRIPTION OF THE PREFERRED EMBODIMENT

Figure 1:
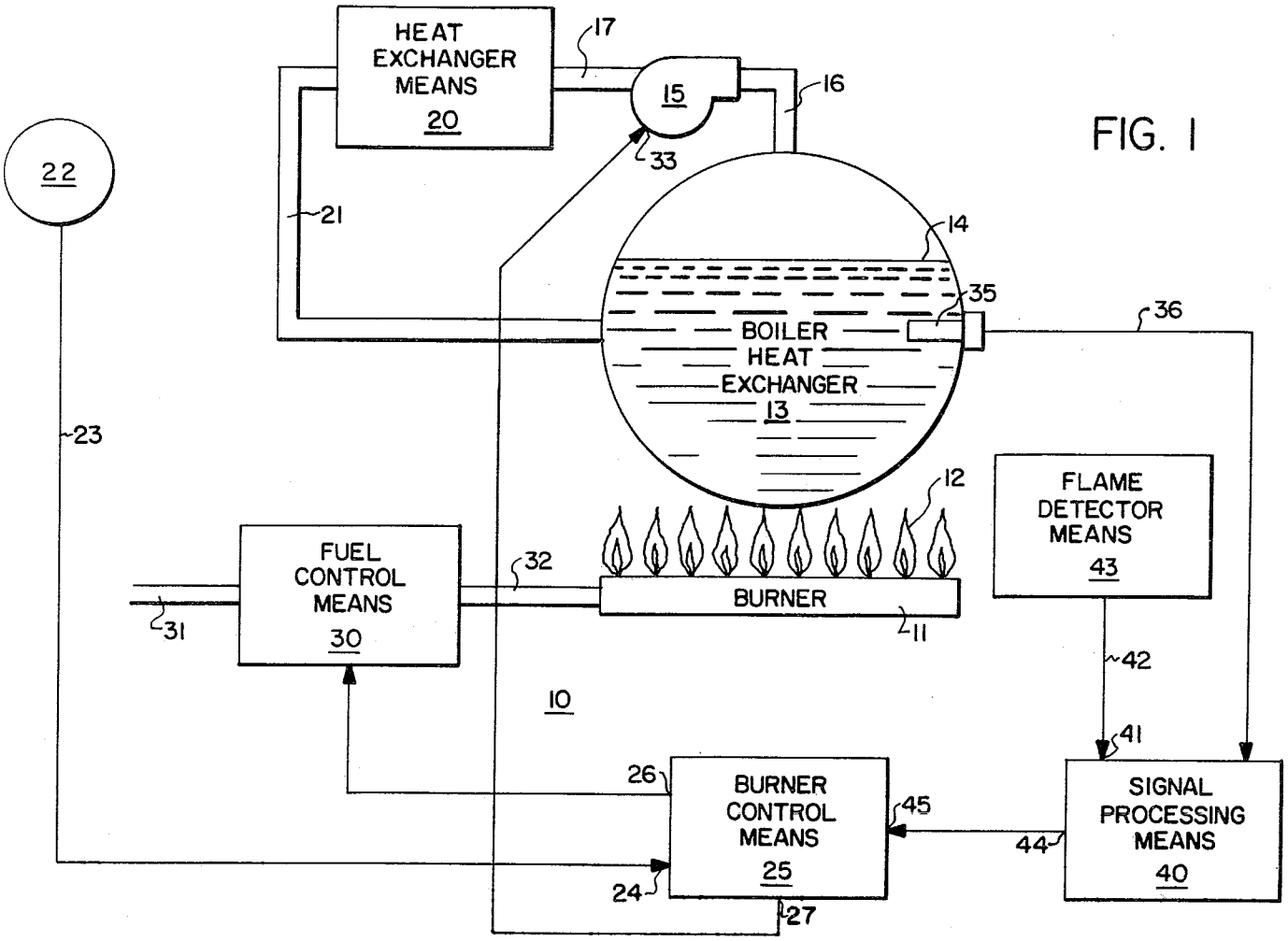
FIG. 1 is a drawing of a complete antirust hydronic type system.

The present burner control system 10 is adapted to control a conventional burner 11 in an antirust mode. The burner 11 supplies a flame 12 to a boiler heat exchanger 13 which is filled with water to a level 14. A water circulator means 15 is connected by a pipe 16 to the boiler 13 and in turn has an inlet pipe 17 that is connected to a heat exchanger means 20. The heat exchanger means 20 would be a conventional radiator or a series of radiators. The heat exchanger means 20 is connected by an inlet pipe 21 back to the boiler 13.

An ambient temperature control means 22 is provided and is disclosed as a conventional thermostat that is connected by a cable 23 to an input means 24 for a burner control means disclosed at 25. The burner control means 25 is a time based controller that is capable of measuring the rate of change of a signal with respect to a time base that is internally generated or synchronized with the line frequency applied to the device or by some other means. Typically the controller or burner control means 25 could be a microcomputer, such as the Model COP440 manufactured by the National Semiconductor Corporation.

The burner control means 25 has two output means 26 and 27. The output means 26 provides an electrical signal to a fuel control means generally disclosed at 30 and could by any type of a valve that is electrically operable between a closed or "off" position, and an "on" position to supply a fluid or gaseous fuel from a pipe 31 to a pipe 32 that in turn supplies the burner 11. The output means 27 supplies a signal at 33 to the water circulator means or circulator pump 15 to energize it.

The boiler water 14 is sensed in temperature by a temperature sensing means or boiler temperature sensing means 35 that is connected by conductors 36 to a signal processing means 40. The signal processing means 40 also has a further input at 41 from a cable 42 and a flame detector means 43. The flame detector means 43 is of conventional design and responds to the burner 11 in a conventional manner. The signal processing means 40 has an output at 44 that is supplied as an input at 45 to the burner control means 25. The signal processing means 40 is a multiplexer and analog-to-digital converter and could be any type. A typical multiplexer and analog-to-digital converter could be a National Semiconductor device known as a Model ADC0833.

OPERATION

The operation of the system disclosed in FIG. 1 relies on the thermostat 22 indicating that a rise in temperature at the heat exchanger means 20 is desirable. The burner control means energizes the fuel control means 30 and supplies fuel to the burner 11 where it is ignited in a conventional manner and sensed by the flame detector means 43. The burner control means 25 at this time does not supply a signal to the circulator pump 15, but awaits an input from the signal processing means 40. The signal processing means 40 through the sensor 35 senses the boiler water temperature in the boiler heat exchanger 13 and this information is supplied to the burner control means 25 where a rate of rise is measured. The rate of rise is used to determine that the boiler water 14 is being heated by the flame 12. If it is being heated too rapidly, the system will shut down as that is an indication of a potential low water condition. If it is being heated at a proper rate, the rate of rise function of the burner control means 25 will eventually supply an "on" signal at the output 27 to energize the circulator pump 15 so that heated water in the heat exchanger means 20 can in turn satisfy the call for heat from the thermostat 22.

If a rate of rise is present, but is too slow to accommodate the rate of rise set into the system, this indicates that the burner is not functioning properly and the system will react accordingly, e.g. in a set period of time shut down and lock out the burner 11 thereby requiring a manual reset. The system could further encompass an annunciator even though none is specifically shown in FIG. 1.

The system of FIG. 1 thus simply accomplishes an antirust mode of operation of the boiler heat exchanger 13 by ensuring that the water 14 is adequately and properly heated before the circulator pump 15 is energized to circulate the water through the heat exchanger means 20. The system also is capable of the safety functions of low water cut off, and of shutting the system down if the burner is not providing adequate heat to the water 14 to raise the temperature of the water in a proper manner.

In FIG. 2 a flow chart of the system is disclosed and is substantially self-explanatory. Only brief comments will be provided. The flow chart of FIG. 2 starts when the flame is proved at 50 and a temperature is noted at 51. This defines the value of the temperature in the boiler water and assigns it the designation as TBW1 which is the temperature of the boiler water at a moment of time T1. This information is noted at 52 where it is fed to a decision block 53. The decision block compares the temperature of the boiler water to make sure that it is greater than the temperature of the boiler water set as a minimum. If it is, a "yes" output is provided at 54 to provide normal operation at 55.

If the result of the decision is "no" at 56, the time is again noted at 57 where it is again supplied to a decision block 58 which evaluates the time T2 minus time T1 being greater than time interval T3. If it is a "yes" at 60 the information is supplied to a further decision block 61 which compares the temperature of the boiler water (TBW) minus the temperature of the boiler water at moment T1 which must be greater than the rate of change of the temperature of the boiler which at a minimum value ($\Delta$TBWmin). If decision making block 58 has a "no" output at 62 (which indicates that operation is in the antirust mode, i.e. circulating pump 15 is turned off) the burner control means 25 output signals 26 and 27 are set to operate in the antirust mode 63 and then a delay 64 can be added before the next measurement of TBW and T2. A fault 65 occurs if the output of block 61 is a "no".

In FIG. 3 a simpler form of the operation is displayed where the entry is made as flame is proved once again at 50. The system then just notes time as T1 as at 52, and the information flows into the decision making block 53. The output being "yes" at 54 indicates a normal operation 55, wherein an output "no" 56 causes the system to note a second time T2 at 57. A decision making block 58 is provided which has a "yes" output at 60 indicating a fault 65', and a "no" output at 62 which indicates that the system is in an antirust mode of operation 63 and again a delay 64 can be provided.

A portion of the flow chart of FIG. 2 is disclosed in FIG. 4 wherein the low water safety function is disclosed. The block 61 has been replaced by a block 61' in which the temperature of the boiler water TBW is compared against the temperature of the boiler water at interval time TBW1 which must be greater than a rate of change of the temperature of the boiler water at a maximum thereby being able to measure a rapid rise in the rate of change of the temperature of the boiler water indicating a low water condition. It is also possible to combine the tests of 61 and 61' such that both conditions must be met.

The present system can be modified extensively as is exemplified by the difference in the various flow charts of FIGS. 2, 3, and 4, and the present invention is therefore deemed limited solely by the scope of the appended claims.

The embodiments of the invention in which an exclusive property or right is claimed are defined as follows:

1. A burner control system adapted to control a burner for a boiler in an antirust mode with said boiler having water circulator means which moves hot water through the heat exchanger of said boiler and through heat exchanger means of space to be heated, including: ambient temperature control means for supplying a signal responsive to ambient temperature changes; burner control means having first input means connected to said ambient temperature control means; said burner control means having at least two output means with a first of said output means connected to fuel control means for said burner; a second of said output means connected to said water circulator means to control the movement of heated boiler water through said heat exchanger means; flame detector means responsive to the presence or absence of flame at said burner; boiler temperature sensor means responsive to the temperature of the boiler water and having signal output means; and signal processing means connected to said flame detector output means and said boiler temperature sensor output means and having signal output means connected to said burner control means; said burner control means responding to said ambient temperature control means and measuring the rate of rise of temperature of said boiler water to determine when to energize said water circulator means in the event that said rate of rise is adequate thereby indicating proper operation of said burner; said burner control means energizing said water circulating means only after the boiler water temperature has risen to a level sufficient to reduce condensation on said boiler heat exchanger thereby preventing rust from forming on said boiler heat exchanger.

2. A burner control system as described in claim 1 wherein said ambient temperature control means is a thermostat; said fuel control means includes an electrically operated fuel valve; said water circulator means is a circulator pump; and said heat exchanger means includes at least one radiator in an area to effect a temperature change at said thermostat.

3. A burner control system as described in claim 2 wherein said burner control means includes timer means that limits the operating time of a signal and to close said fuel control means in the event that the rate of rise of temperature at said boiler temperature sensor does not occur in a preset safe time interval.

4. A burner control system as described in claim 3 wherein said signal processing means includes a multiplexer and an analog-to-digital converter means to supply said burner control means with a digital control signal to compare with a digital time base provided by said timer means.

5. A burner control system as described in claim 3 wherein if the rate of rise of said boiler water temperature exceeds a rate of rise indicative of a low water condition in said boiler said burner control means then causes said fuel control means to close said fuel valve and disable the operation of said burner.

6. A burner control system as described in claim 5 wherein said signal processing means includes a multiplexer and an analog-to-digital converter means to supply said burner control means with a digital control signal to compare with a digital time base provided by said timer means.

* * * * *

UNITED STATES PATENT AND TRADEMARK OFFICE

CERTIFICATE OF CORRECTION

PATENT NO. : 4,445,638

DATED : May 1, 1984

INVENTOR(S) : JOHN C. CONNELL AND STEPHEN L. SERBER

It is certified that error appears in the above-identified patent and that said Letters Patent is hereby corrected as shown below:

In the title cancel "ANTITRUST" and substitute --ANTIRUST--.

Signed and Sealed this

*Twenty-eighth* Day of *August 1984*

[SEAL]

*Attest:*

*Attesting Officer*

GERALD J. MOSSINGHOFF

*Commissioner of Patents and Trademarks*